US010921738B1

(12) United States Patent
Tsai

(10) Patent No.: US 10,921,738 B1
(45) Date of Patent: Feb. 16, 2021

(54) ERROR PROOF DEVICE FOR TONER CARTRIDGE AND TONER CARTRIDGE USING THE SAME

(71) Applicant: GENERAL PLASTIC INDUSTRIAL CO., LTD., Taichung (TW)

(72) Inventor: Shao-Yuan Tsai, Taichung (TW)

(73) Assignee: GENERAL PLASTIC INDUSTRIAL CO., LTD., Taichung (TW)

( * ) Notice: Subject to any disclaimer, the term of this patent is extended or adjusted under 35 U.S.C. 154(b) by 0 days.

(21) Appl. No.: 16/889,157

(22) Filed: Jun. 1, 2020

(51) Int. Cl.
*G03G 15/20* (2006.01)
*G03G 15/08* (2006.01)

(52) U.S. Cl.
CPC ..... *G03G 15/205* (2013.01); *G03G 15/0863* (2013.01); *G03G 15/0867* (2013.01)

(58) Field of Classification Search
CPC ..... G03G 15/205; G03G 15/0863; G03G 15/0867; G03G 15/087
See application file for complete search history.

(56) References Cited

U.S. PATENT DOCUMENTS

2007/0212119 A1* 9/2007 Kurenuma ..... G03G 15/0894 399/262
2011/0243579 A1* 10/2011 Oshikawa ..... G03G 21/1875 399/12
2011/0305485 A1* 12/2011 Oshikawa ..... G03G 15/087 399/258

* cited by examiner

*Primary Examiner* — Sandra Brase
(74) *Attorney, Agent, or Firm* — Muncy, Geissler, Olds & Lowe, P.C.

(57) ABSTRACT

An error proof device for restricting assembling of a specific toner cartridge into an electronic image-forming apparatus only after the toner cartridge is rotated about a rotation axis includes a guiding portion at the apparatus and a retaining portion at the toner cartridge. The guiding portion has an axial groove and a positioning groove having a circular arc section. The retaining portion has an axial post located at the rotation axis and inserted into the axial groove, and a lateral post spaced from the axial post and inserted into the positioning groove. When the toner cartridge is rotated about the rotation axis, the lateral post moves along the circular arc section of the positioning groove. With the error proof device, a user can positively install a toner cartridge into an accuracy position, thereby avoiding material waste and undesired cleaning procedure due to error installation.

12 Claims, 10 Drawing Sheets

ERROR PROOF DEVICE FOR TONER CARTRIDGE AND TONER CARTRIDGE USING THE SAME

BACKGROUND OF THE INVENTION

1. Field of the Invention

The present invention relates generally to an electronic image-forming apparatus and more particularly, to an error proof device for a toner cartridge for being used in an electronic image-forming apparatus.

2. Description of the Related Art

Electronic image-forming apparatuses, such as photocopiers, multifunctional printers, etc., have become indispensable aiding tools in modern work and life. In order to print out color texts and/or photos, four toner cartridges of different colors are generally required. Each toner cartridge of specific color has its own position in work. If a user accidentally installs or replaces a toner cartridge of specific color in a wrong position, the user may be warned by the electronic image-forming apparatus, so that the user may have a chance to reload the toner cartridge of specific color to a correct position so as to fix the problem in time. However, the user may not notice that the toner cartridge of specific color was installed into a wrong position until texts and/or photos of wrong colors are printed out. In such a situation, the user has to spend additional time to find out which toner cartridge is erroneously installed, and may need to clean the peripheral components contaminated by different colors, resulting in consuming time and wasting money.

SUMMARY OF THE INVENTION

The present invention has been accomplished in view of the above-noted circumstances. It is an objective of the present invention to provide an error proof device for a toner cartridge, which can ensure that a predetermined toner cartridge can be positively assembled into a correct position so as to avoid waste of time and money.

To attain the above-mentioned objective, the present invention provides an error proof device adapted for restricting that a specific toner cartridge is allowed to be assembled into an electronic image-forming apparatus only after the specific toner cartridge is rotated about a rotation axis. The error proof device comprises a guiding portion and a retaining portion. The guiding portion is provided at the electronic image-forming apparatus and provided with an axial groove and a positioning groove. The axial groove is intersected with the rotation axis, and the positioning groove has a circular arc section with a center of curvature located at the rotation axis. The retaining portion is provided at an end of the specific toner cartridge and provided with an axial post and a lateral post. The axial post is located at the rotation axis and inserted into the axial groove. The lateral post is spaced from the axial post and inserted into the positioning groove. When the specific toner cartridge is rotated about the rotation axis, the lateral post moves along the circular arc section of the positioning groove.

Another objective of the present invention is to provide a toner cartridge, which is adapted for being assembled into an electronic image-forming apparatus after the toner cartridge is rotated about a rotation axis. The electronic image-forming apparatus comprises a guiding portion including an axial groove and a positioning groove. The guiding groove is intersected with the rotation axis, and the positioning groove has a circular arc section with a center of curvature located at the rotation axis. The toner cartridge comprises a housing and a retaining portion disposed at an end of the housing. The retaining portion is provided with an axial post and a lateral post. The axial post is located at the rotation axis and inserted into the axial groove. The lateral post is spaced from the axial post and adapted for being inserted into the positioning groove. When the toner cartridge is rotated about the rotation axis, the lateral post moves along the circular arc section of the positioning groove.

Because the structure of the retaining portion of the toner cartridge of different characteristic, such as color, corresponds to and matches with the structure of the guiding portion of different position of the electronic image-forming apparatus, the specific toner cartridge can be coupled to a specific guiding portion only, resulting in that an undesired toner cartridge cannot be coupled to a specific guiding portion of the electronic image-forming apparatus. As a result, the error proof device for a toner cartridge can ensure that a user can positively install a desired toner cartridge into a correct position of an electronic image-forming apparatus, thereby avoiding waste of time for fixing error installation so as to achieve the objective of saving time and money.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
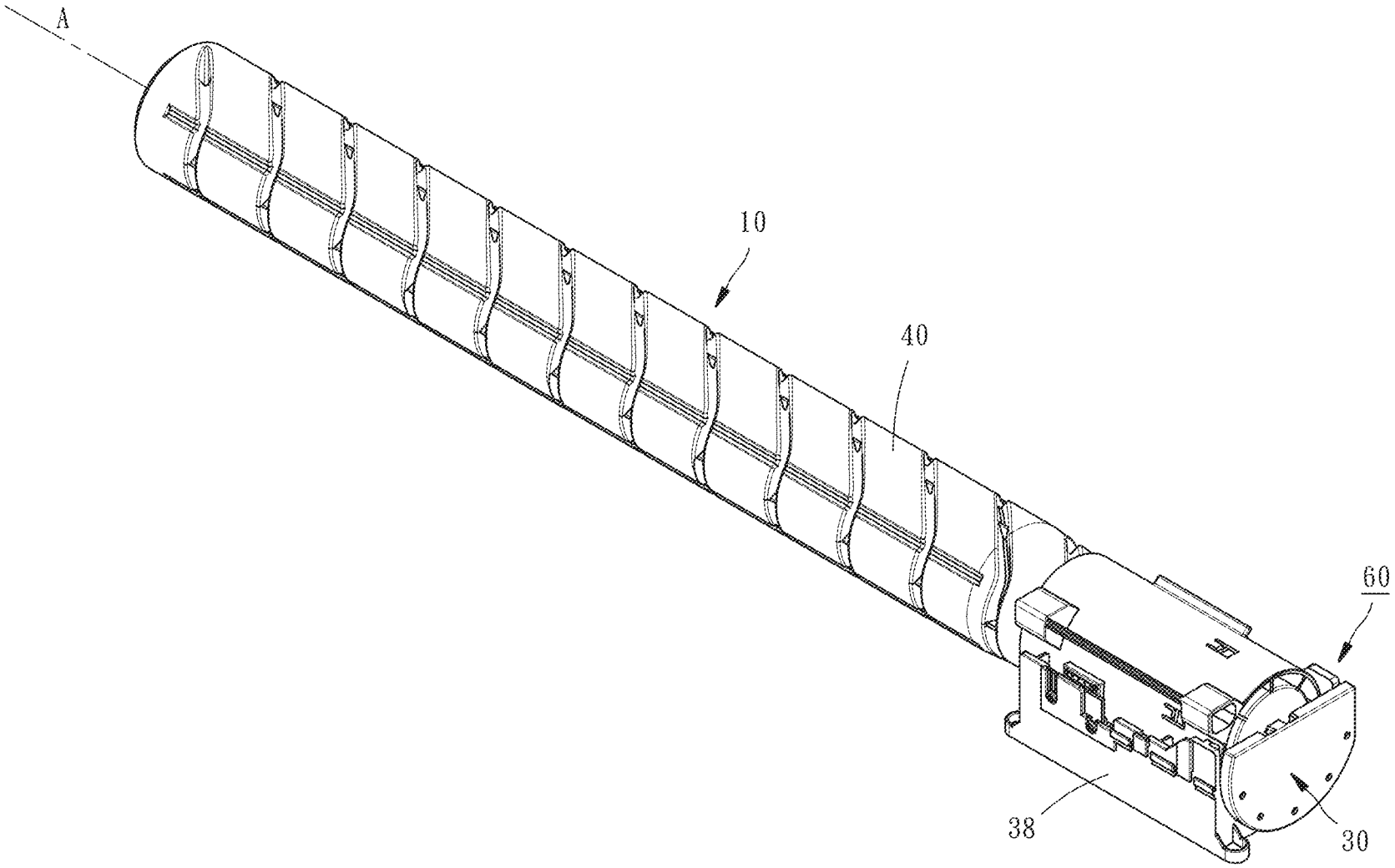
FIG. 1 is a perspective view of an error proof device for a toner cartridge according to a first embodiment of the present invention.
Figure 2:
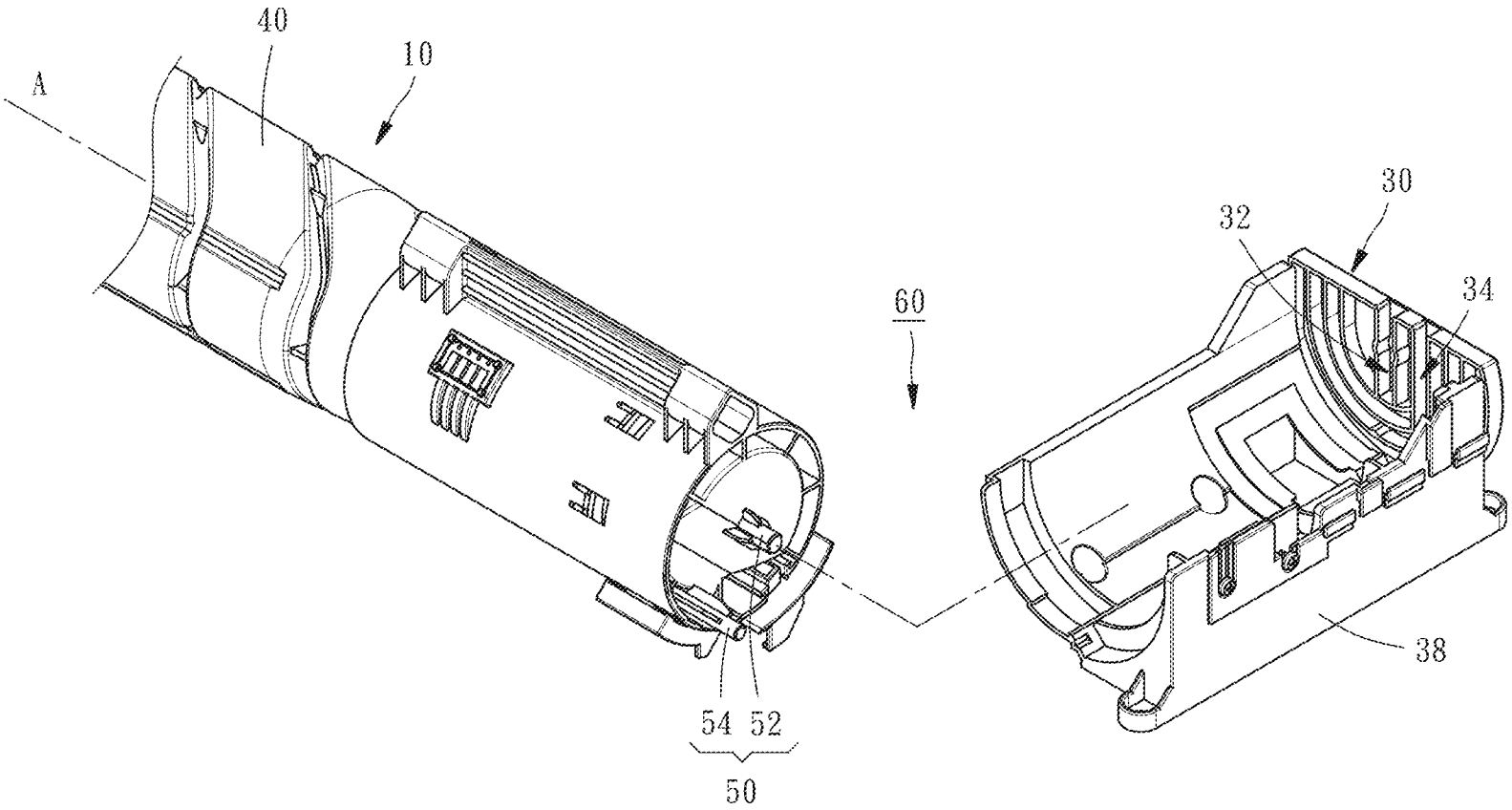
FIG. 2 is an exploded perspective view of the error proof device for the toner cartridge of the first embodiment of the present invention.

Hereunder two embodiments will be detailedly described with accompanying drawings for illustrating technical features and structure of the present invention. Referring to FIGS. 1 and 2, a toner cartridge 10 provided in accordance with a first embodiment of the present invention is adapted for being assembled into an electronic image-forming apparatus (not shown in the drawings) only after the toner cartridge 10 is rotated about a rotation axis A. The electronic image-forming apparatus comprises a guiding portion 30 and an accommodation portion 38. The toner cartridge 10 comprises a housing 40 and a retaining portion 50 mounted to an end of the housing 40. The guiding portion 30 and the retaining portion 50 combinedly form an error proof device 60 for a toner cartridge. The error proof device 60 is adapted for restricting that a specific toner cartridge, namely the toner cartridge 10, is allowed to be assembled into the accommodation portion 38 of an electronic image-forming apparatus only after the specific toner cartridge is rotated about the rotation axis A.

Figure 3:
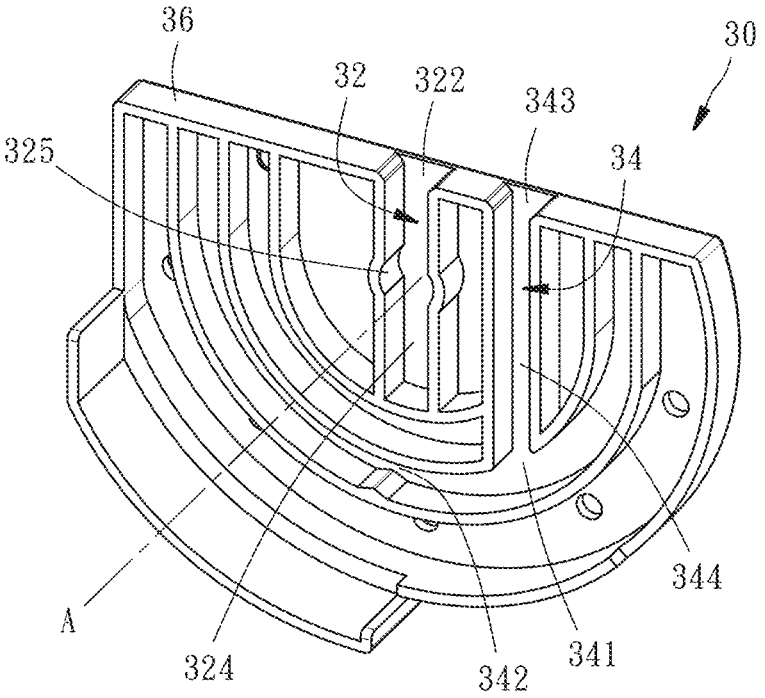
FIG. 3 is a perspective view of a guiding portion of the error proof device for the toner cartridge of the first embodiment of the present invention.

Referring to FIG. 3, the guiding portion 30 includes an axial groove 32 and a positioning groove 34. The axial groove 32 extends vertically and is spaced at a predetermined distance from the positioning groove 34. The axial groove 32 is intersected with the rotation axis A. The positioning groove 34 has a circular arc section 341 with a neck portion 342 having a width smaller than that of the other portion of the positioning groove 34. The circular arc section 341 includes a center of curvature located at the rotation axis A. The guiding portion 30 is provided at an outer periphery thereof, i.e. the top edge, with a stop surface 36. The axial groove 32 includes a first inlet 322 provided at a middle of the stop surface 36, and a first extension portion 324 extending vertically and downwardly from the first inlet 322 and being intersected with the rotation axis A. The positioning groove 34 includes a second inlet 343 provided at the stop surface 36, and a second extension portion 344 extending vertically and downwardly from the second inlet 343. The aforesaid circular arc section 341 extends from a bottom of the second extension portion 344. The first extension portion 324 is parallel to the second extension portion 344.

Figure 4:
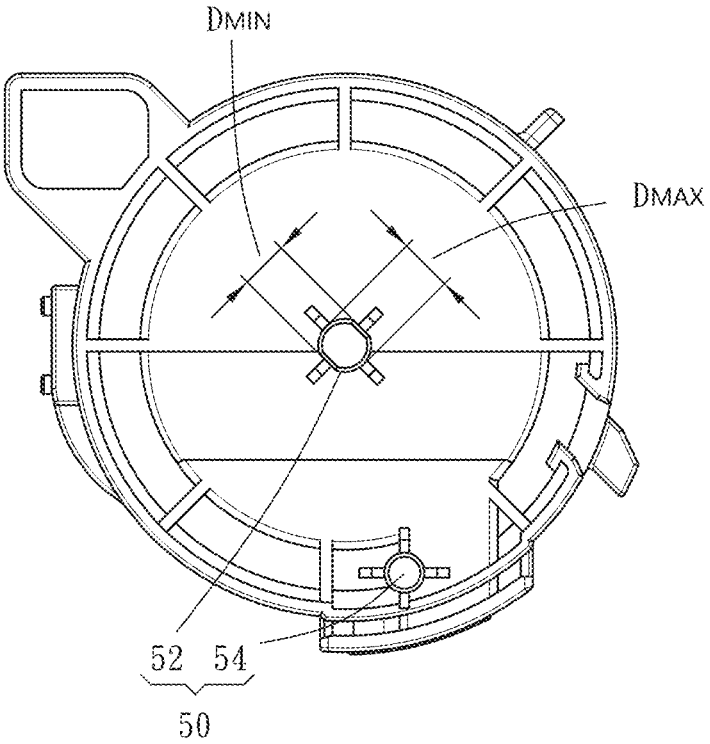
FIG. 4 is a front view of a retaining portion of the error proof device for the toner cartridge of the first embodiment of the present invention.

Referring to FIGS. 2 and 4, the retaining portion 50 includes an axial post 52 and a lateral post 54. The axial post 52 is located at the rotation axis and inserted into the axial groove 32 of the guiding portion 30. The lateral post 54 is spaced at a predetermined distance from the axial post and inserted into the positioning groove 34 of the guiding portion 30. The axial post 52 and the lateral post 54 are both parallel to the rotation axis A. When the toner cartridge 10 is rotated, the lateral post 54 can move along the circular arc section 341 of the positioning groove 34 in a way that the lateral post 54 can be forced to pass through the neck portion 342. The axial post 52 has a noncircular cross-section, such that the axial post 52 has diameters varying between a smallest diameter $D_{MIN}$ and a largest diameter $D_{MAX}$ at various circumferential angles. In this embodiment, the cross-section of the axial post 52 is composed of two circular arcs, and two plat planes opposite to each other and each located and connected between the two circular arcs, such that the largest diameter $D_{MAX}$ is the diameter of the circular arcs and the smallest $D_{MIN}$ is the distance between the two plat planes. The first inlet 322 of the axial groove 32 has a width greater than the smallest diameter $D_{MIN}$ and smaller than the largest diameter $D_{MAX}$ of the axial post 52. In this embodiment, the width of the first inlet 322 is slightly greater than the $D_{MIN}$, such that the axial post 52 can move from the first inlet 322 into the first extension portion 324 when the lateral post 54 moves from the second inlet 343 of the guiding groove 34 into the second extension portion 344. The first extension portion 324 has a widened portion 325 at an intersection portion between the first extension portion 324 and the rotation axis A. The widened portion 325 has a width greater than that of the other portion of the first extension portion 324 and slightly greater than the largest diameter $D_{MAX}$, such that the axial post 52 can freely rotate in the widened portion 325.

Figure 5:
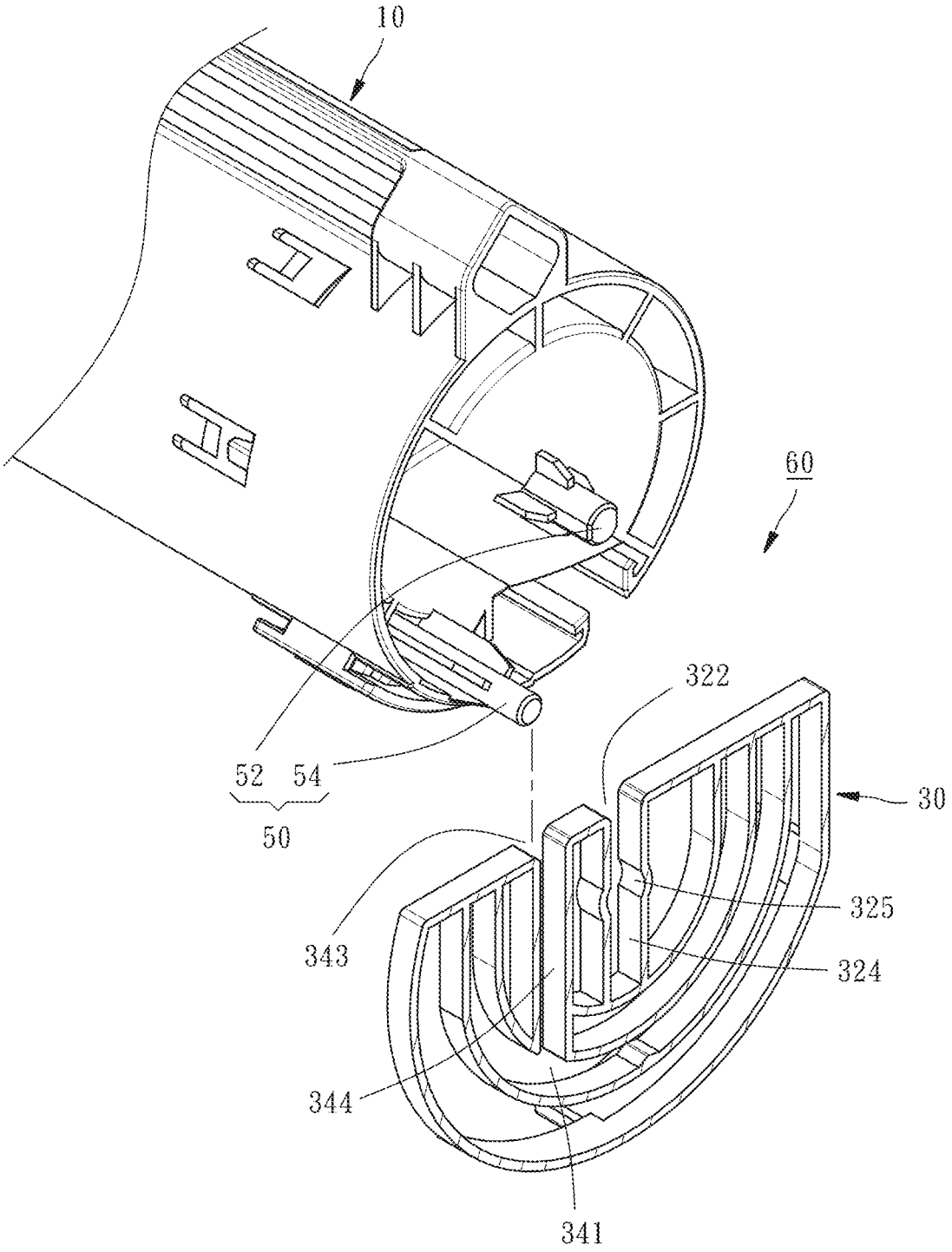
FIGS. 5-8 are views showing motions of installing the retaining portion into the guiding portion in accordance with the first embodiment of the present invention.
Figure 6:
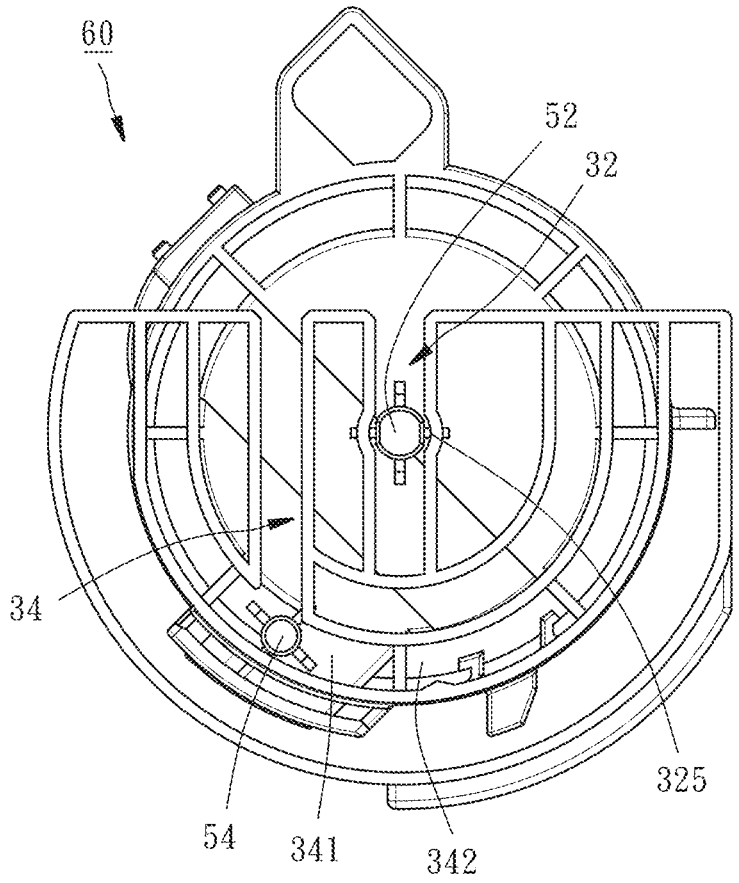
Figure 7:
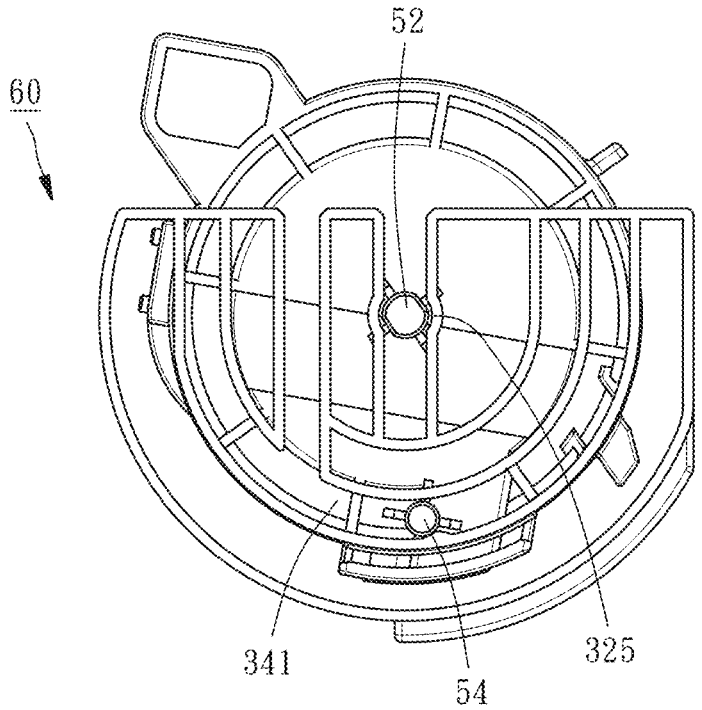
Figure 8:
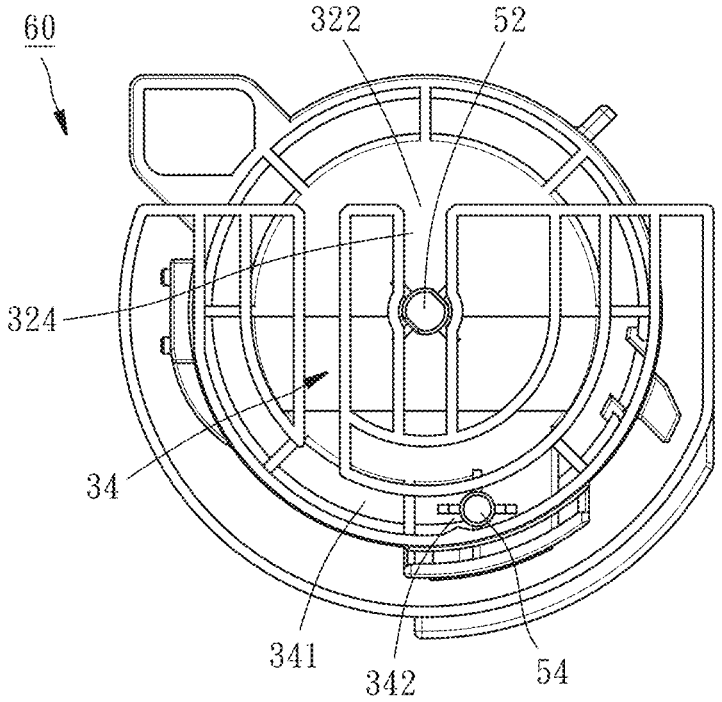

Because the error proof device 60 is used to restrict that only a toner cartridge of specific color or specific characteristic can be assembled to a predetermined position of the electronic image-forming apparatus, hereunder a toner cartridge 10 containing cyan toners and a guiding portion 30 that can be coupled to the retaining portion 50 of the aforesaid specific toner cartridge 10 will be used with reference to the appendix drawings as exemplary embodiment for illustrating the technical features and effects of the present invention. Referring to FIG. 5, to install the toner cartridge 10 into the electronic image-forming apparatus, the user holds the toner cartridge 10 in a horizontal posture and then moves the toner cartridge 10 downwardly towards the accommodation portion 38 to enable that the lateral post 54 moves into the second extension portion 344 through the second inlet 343 and thereafter the axial post 52 moves into the first extension portion 324 in a way that the smallest diameter $D_{MIN}$ of the axial post 52 passes through the first inlet 322. As shown in FIG. 6, when the axial post 52 arrives at the widened portion 325, the lateral post 54 will just enter into the circular arc section 341 of the positioning groove 34. Thereafter, the user turns the toner cartridge 10 to enable the toner cartridge 10 to counterclockwise rotate, based on the viewing angle of FIGS. 6 and 7, about the axial axis A, as shown in FIG. 7. During the rotational motion, the axial post 52 rotates in its place, i.e. spins, about the rotation axis A in the widened portion 352, and while the lateral post 54 will move along the circular arc section 341. Referring to FIG. 8, the user continuously turns the toner cartridge 10 to enable that the lateral post 54 will be forced to pass through the neck portion 342 of the circular arc section 341, thereby completing installation of the toner cartridge 10 into the electronic image-forming apparatus. At this stage, unless the user reversely turns the toner cartridge 10, the toner cartridge 10 will not escape from the guiding portion 30 due to the grounds that the lateral post 54 is restricted by the neck portion 342 and cannot reversely pass through the neck portion 342, as shown in FIG. 1.

From the above-mentioned description, it can be understood that the guiding portion 30 will only receive a toner cartridge 10 having a specific retaining portion 50 that can be associated with the guiding portion 30 due to the fact that the guiding portion 30 has a special structural configuration. The retaining portion 50 just likes a specific key that can be inserted into a lock and then open the lock. As such, the error proof device 60 can ensure installation of a correct toner cartridge. By means of providing guiding portions of various structural features at different positions of the electronic image-forming apparatus, it can ensure that each of the toner cartridges containing different colored toners can be positively assembled to its desired position correctly. Hereunder an installation of a toner cartridge of different color will be illustrated for better understanding the features and effects of the present invention.

Figure 9:
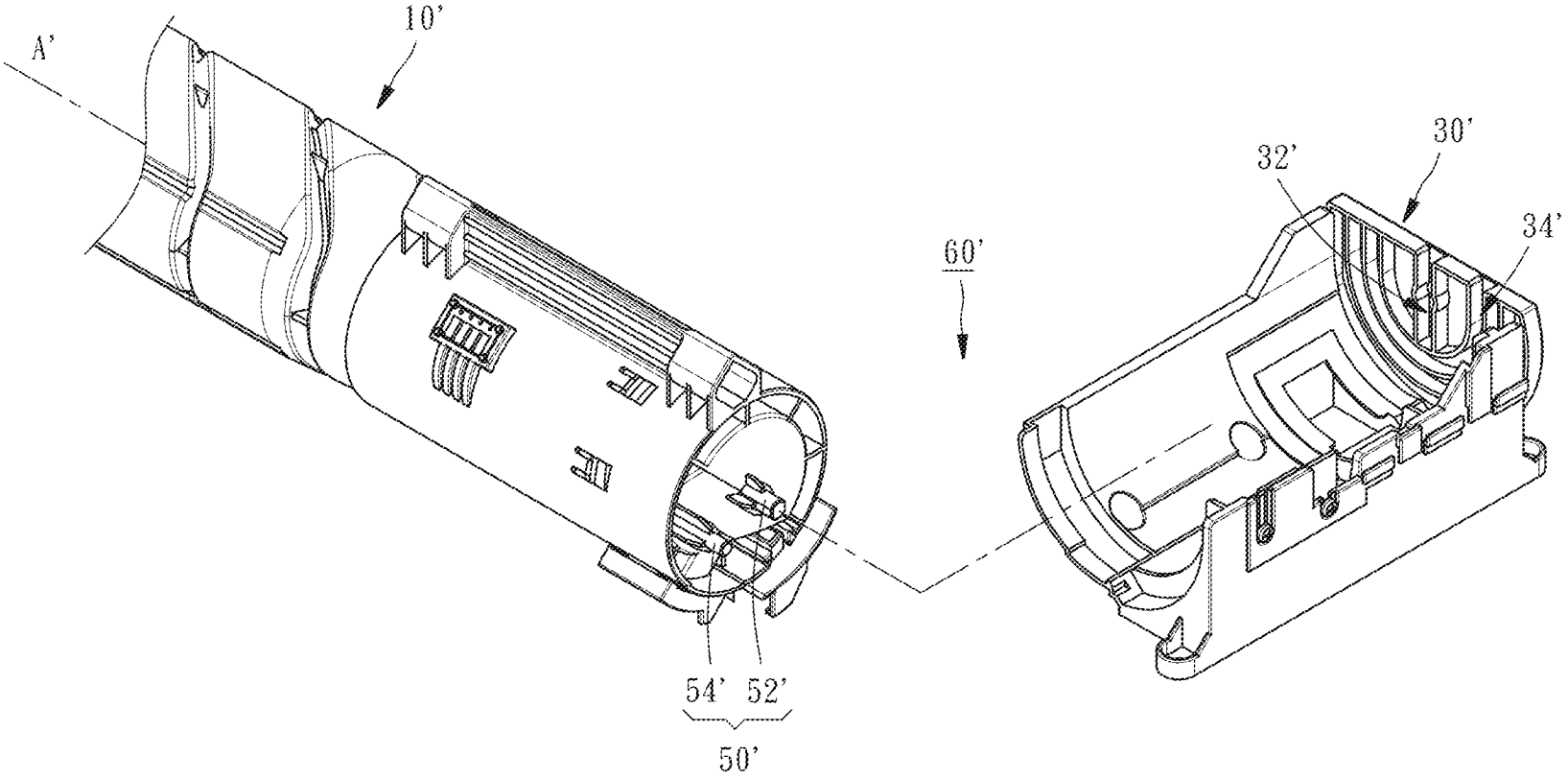
FIG. 9 is an exploded perspective view of an error proof device for a toner cartridge according to a second embodiment of the present invention.
Figure 10:
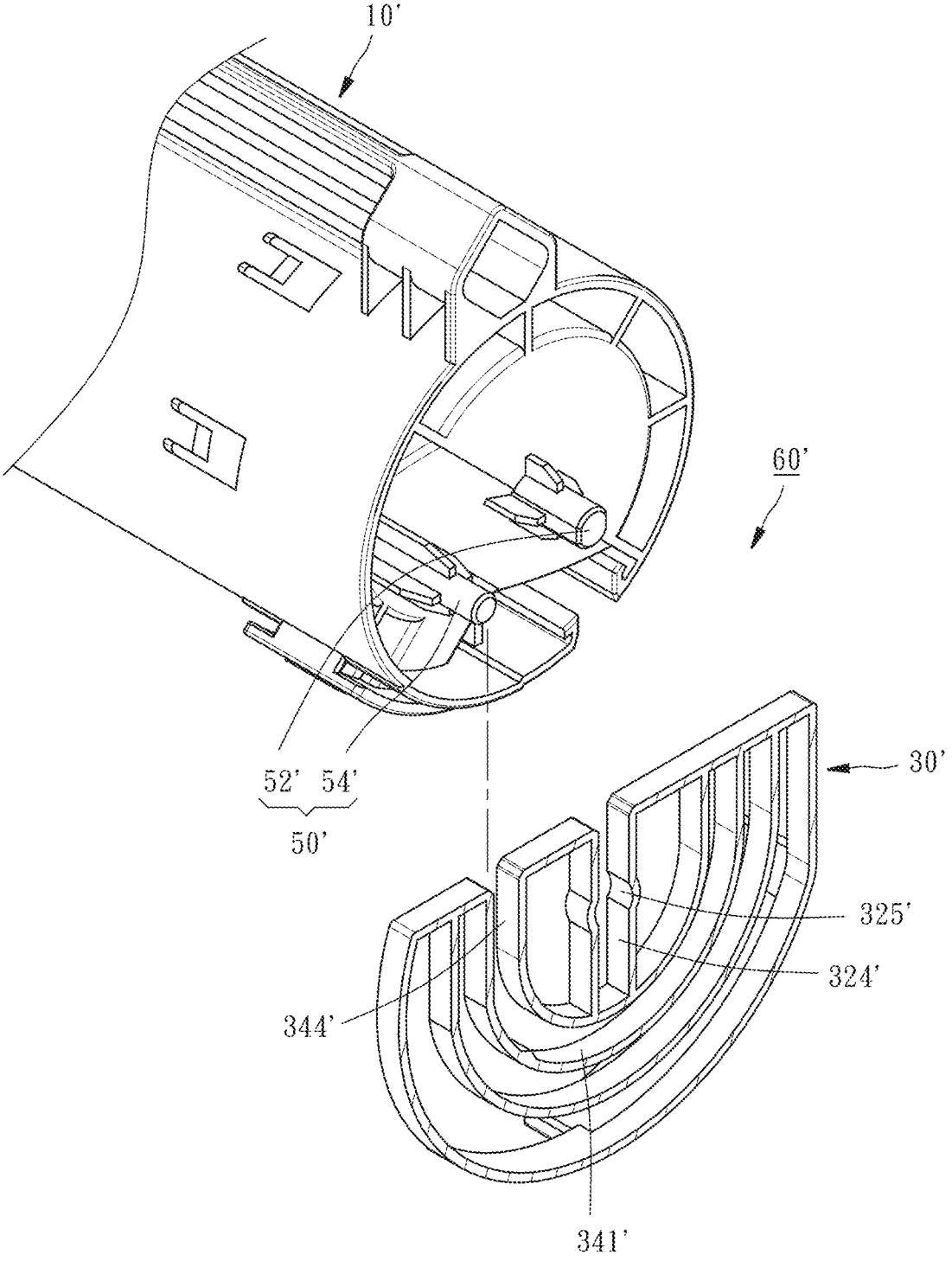
FIGS. 10-14 are views showing motions of installing the retaining portion into the guiding portion in accordance with the second embodiment of the present invention.

Referring to FIG. 9, a toner cartridge 10' containing black toners is illustrated in accordance with a second embodiment of the present invention. The structure of the toner cartridge 10' is basically similar to that of the toner cartridge 10 of the first embodiment. The toner cartridge 10' includes a retaining portion 50' provided with an axial post 52' and a lateral post 54', too. However, the distance between the axial post 52' and the lateral post 54' and the relative position therebetween are different from that of the first embodiment. In another aspect, the electronic image-forming apparatus includes a guiding portion 30' which has a structure basically similar to that of the guiding portion 30 of the first embodiment, except that the distance between the axial groove 32' and the positioning groove 34' becomes smaller, the length of the second extension portion 344' becomes shorter, and the position of the neck portion 342' is different from that of the first embodiment. The guiding portion 30' and the retaining portion 50' combinedly form an error proof device 60' for another toner cartridge.

Figure 11:
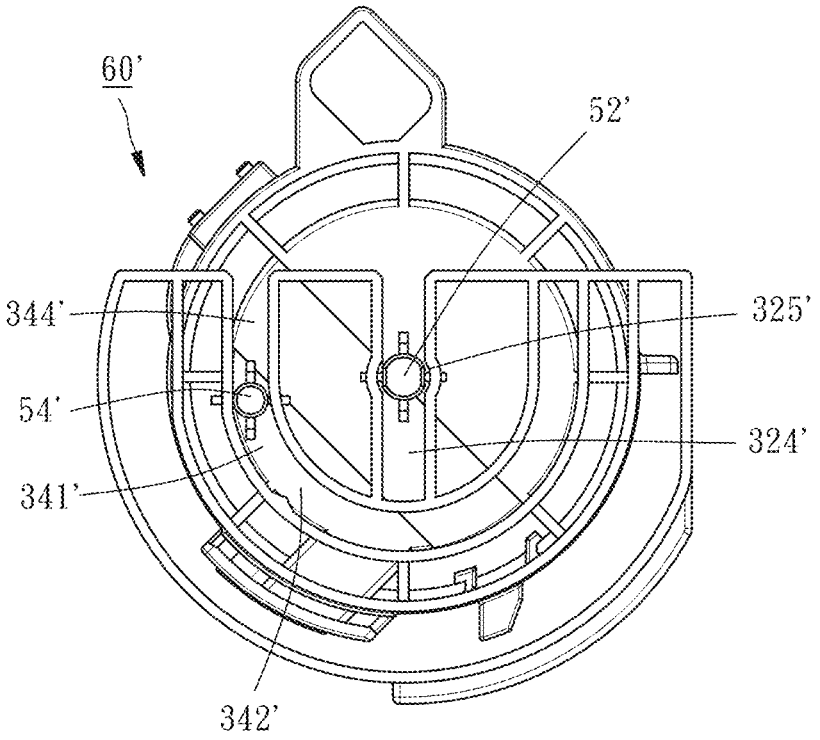
Figure 12:
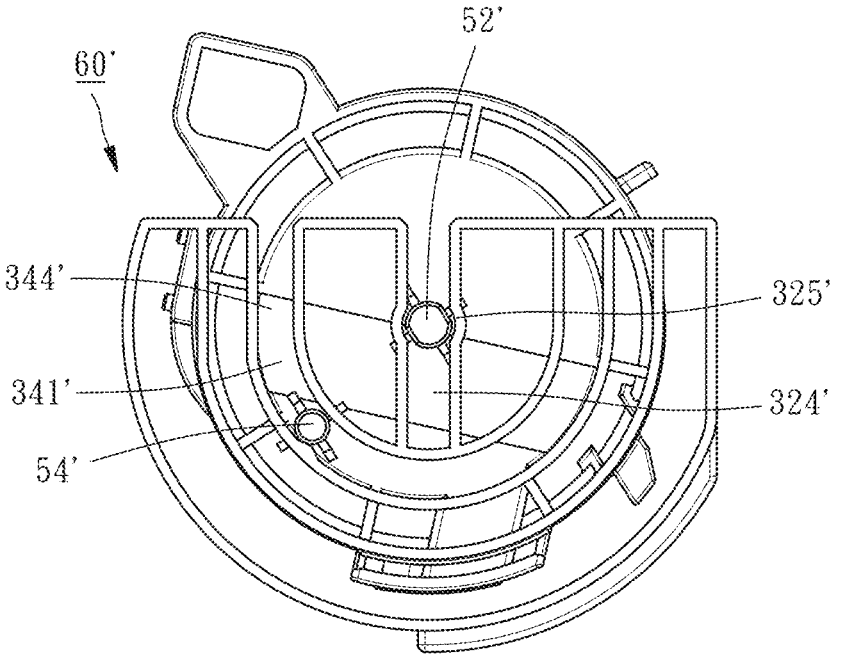
Figure 13:
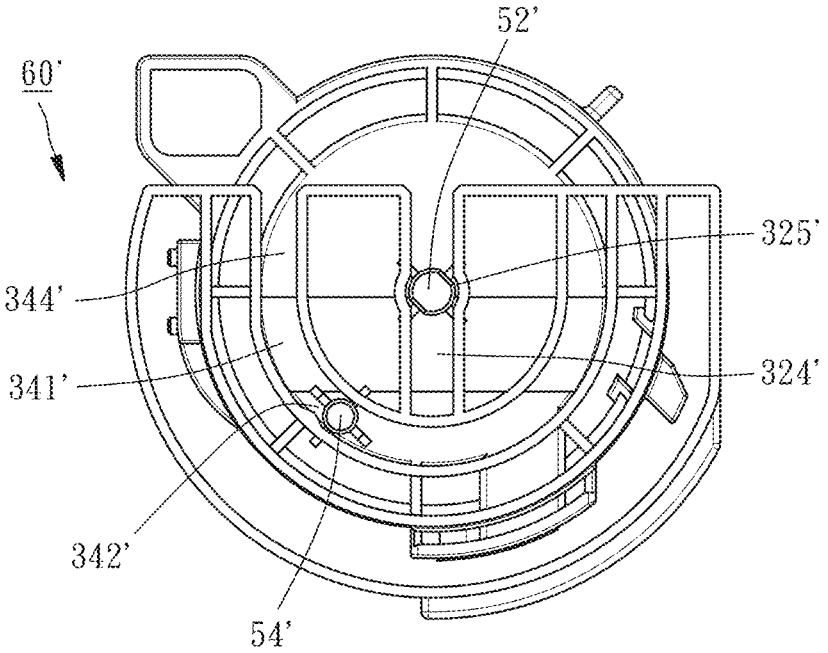
Figure 14:
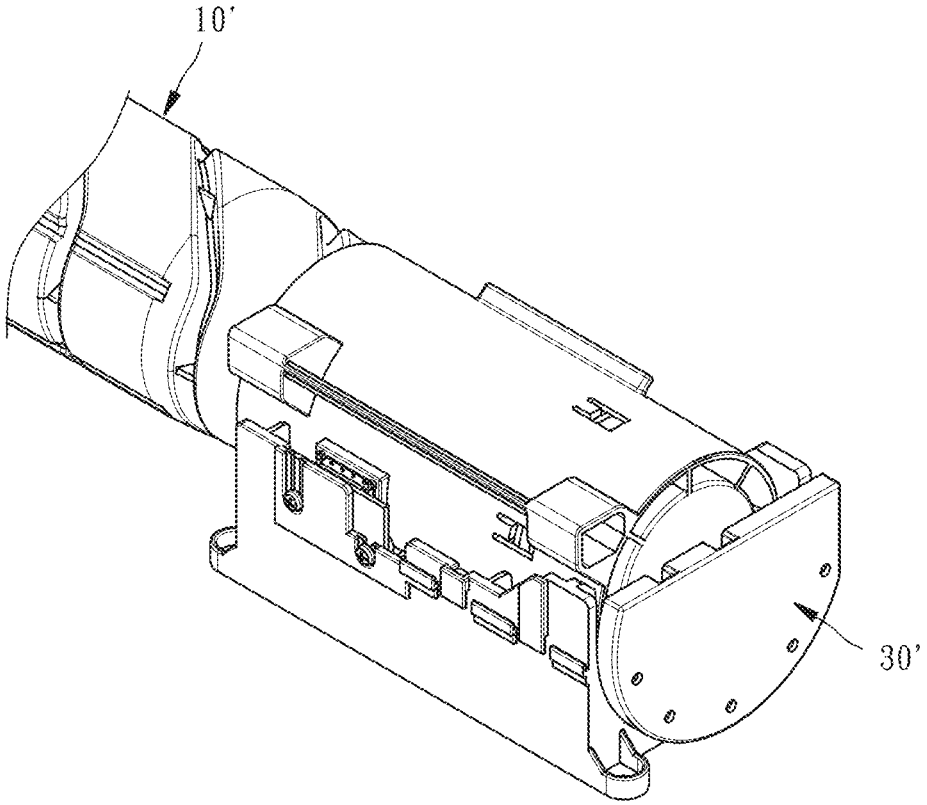

The procedure of installing the toner cartridge 10' containing black toners into the electronic image-forming apparatus is basically similar to the installation procedure of the toner cartridge 10 disclosed in first embodiment. As shown in FIGS. 10-13, the toner cartridge 10' is first moved downwardly to enable that the lateral post 54' moves into the second extension portion 344' and thereafter the axial post 52' moves into the first extension portion 324'. As shown in FIG. 11, when the axial post 52' arrives at the widened portion 325', the lateral post 54' just enters into the circular arc section 341'. Thereafter, the user turns the toner cartridge 10' to counterclockwise rotate, based on the viewing angle of FIGS. 11 and 12, about the axial axis A' until the lateral post 54' is forced to pass through the neck portion 342', thereby completing installation of the toner cartridge 10' into the electronic image-forming apparatus, as shown in FIGS. 13 and 14, and then the user stops turning the toner cartridge 10'.

From the descriptions of the above-mentioned first and second embodiments, it can be understood that the toner cartridge 10 equipped with the retaining portion 50 cannot be assembled into the guiding portion 30' provided at the electronic image-forming apparatus because the structure of the retaining portion 50 does not match the structure of guiding portion 30'. Similarly, if a user takes the toner cartridge 10' to assembly it into the guiding portion 30, the toner cartridge 10' will not be able to be successfully assembled with the image-forming apparatus. In short, the error proof devices 60 and 60' can ensure that the user can install a toner cartridge of specific color or specific characteristic into a correct position of an electronic image-forming apparatus so as to avoid waste of material and time due to error installation or avoid the work for cleaning the peripheral components contaminated by different colored toners, thereby achieving the objective of saving time and money of the present invention.

Based on the above-mentioned technical features, various modifications to the structure of the error proof devices 60 and 60' may be made. For example, the axial post 52 or the lateral post 54 is not limited to parallel the rotation axis A, and may be configured having other structures and shapes. Similarly, the structures of the axial groove 32 and the positioning groove 34 may be modified according to the modifications of the axial post 52 and the lateral post 54. For example, the first extension portion 324 and the second extension portion 344 may not be parallel to each other or may not extend downwardly as long as the structures of the axial groove 32 and the positioning groove 34 can match the structures of the axial post 52 and the lateral post 54. In another embodiment, the lateral post 54 and the axial post 52 may simultaneously enter the guiding portion 30, or the axial post 52 enters the guiding portion 30 earlier than the lateral post 54 enters the guiding portion 30. Further, the neck portion 342 of the circular arc section 341 of the positioning groove 34 is used to restrict and position the lateral post 54. In another embodiment of the present invention, the neck portion 342 may be configured into other structures. For example, a resilient piece may be provided in the circular arc section 341 to achieve the same effect that the neck portion 342 can achieve.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An error proof device adapted for restricting that a specific toner cartridge is allowed to be assembled into an electronic image-forming apparatus only after the specific toner cartridge is rotated about a rotation axis, the error proof device comprising:

a guiding portion disposed at the electronic image-forming apparatus and provided with an axial groove intersected with the rotation axis, and a positioning groove having a circular arc section with a center of curvature located at the rotation axis; and a retaining portion disposed at an end of the specific toner cartridge and provided with an axial post located at the rotation axis and inserted into the axial groove, and a lateral post spaced from the axial post and inserted into the positioning groove;

wherein when the specific toner cartridge is rotated about the rotation axis, the lateral post moves along the circular arc section of the positioning groove.

2. The error proof device as claimed in claim 1, wherein the axial post and the lateral post are both parallel to the rotation axis.

3. The error proof device as claimed in claim 1, wherein the circular arc section of the positioning groove includes a neck portion; the lateral post is forced to pass through the neck portion when the specific toner cartridge is rotated about the rotation axis.

4. The error proof device as claimed in claim 1, wherein the guiding portion is provided at an outer periphery thereof with a stop surface; the axial groove includes a first inlet at the stop surface, and a first extension portion extending from the first inlet and being intersected with the rotation axis; the positioning groove includes a second inlet at the stop surface, and a second extension portion extending from the second inlet; the circular arc section extends from the second extension portion.

5. The error proof device as claimed in claim 4, wherein the first extension portion extends downwardly from the first inlet.

6. The error proof device as claimed in claim 4, wherein the first extension portion is parallel to the second extension portion.

7. The error proof device as claimed in claim 4, wherein the axial post has a noncircular cross-section, such that the axial post has diameters varying between a smallest diameter and a largest diameter at various circumferential angles; the first inlet has a width greater than the smallest diameter and smaller than the largest diameter, such that the axial post moves from the first inlet into the first extension portion when the lateral post moves from the second inlet into the second extension portion; the first extension portion has a widened portion at an intersection portion between the first extension portion and the rotation axis, and the widened portion has a width greater than that of the other portion of the first extension portion in a way that the axial post is rotatable in the widened portion.

8. A toner cartridge, which is adapted for being assembled into an electronic image-forming apparatus after the toner cartridge is rotated about a rotation axis, the electronic image-forming apparatus comprising a guiding portion including an axial groove intersected with the rotation axis, and a positioning groove having a circular arc section with a center of curvature located at the rotation axis, the toner cartridge comprising:

a housing; and a retaining portion disposed at an end of the housing and provided with an axial post located at the rotation axis and inserted into the axial groove, and a lateral post spaced from the axial post for being inserted into the positioning groove;

wherein when the toner cartridge is rotated about the rotation axis, the lateral post moves along the circular arc section of the positioning groove.

9. The toner cartridge as claimed in claim 8, wherein the axial post and the lateral post are both parallel to the rotation axis.

10. The toner cartridge as claimed in claim 8, wherein the circular arc section of the positioning groove includes a neck portion; the lateral post is forced to pass through the neck portion when the toner cartridge is rotated about the rotation axis.

11. The toner cartridge as claimed in claim 8, wherein the guiding portion of the electronic image-forming apparatus is provided at an outer periphery thereof with a stop surface; the axial groove includes a first inlet at the stop surface, and a first extension portion extending from the first inlet and being intersected with the rotation axis; the positioning groove includes a second inlet at the stop surface, and a second extension portion extending from the second inlet; the circular arc section extends from the second extension portion.

12. The toner cartridge as claimed in claim 11, wherein the axial post has a noncircular cross-section, such that the axial post has diameters varying between a smallest diameter and a largest diameter at various circumferential angles; the first inlet has a width greater than the smallest diameter and smaller than the largest diameter, such that the axial post moves from first inlet into the first extension portion when the lateral post moves from the second inlet into the second extension portion; the first extension portion has a widened portion at an intersection portion between the first extension portion and the rotation axis, and the widened portion has a width greater than that of the other portion of the first extension portion in a way that the axial post is rotatable in the widened portion.

* * * * *